United States Patent [19]

Nayar

[11] 3,982,904

[45] Sept. 28, 1976

[54] METAL RINGS MADE BY THE METHOD OF PARTICLE RING-ROLLING

[75] Inventor: Harbhajan S. Nayar, Plainfield, N.J.

[73] Assignee: Viking Metallurgical Corporation, Verdi, Nev.

[22] Filed: Apr. 23, 1974

[21] Appl. No.: 463,231

Related U.S. Application Data

[60] Division of Ser. No. 374,184, June 27, 1973, Pat. No. 3,834,003, which is a continuation-in-part of Ser. No. 303,160, Nov. 2, 1972, abandoned.

[52] U.S. Cl. ..... 29/182; 29/182.3; 29/182.7; 29/182.8; 29/420.5; 75/200; 75/208 R

[51] Int. Cl.[2] ..... B22F 3/00; B22F 5/00

[58] Field of Search ..... 75/200, 208 R, 203, 75/204; 29/182, 182.3, 182.7, 182.8, 420.5

[56] References Cited

UNITED STATES PATENTS

| | | | |
|---|---|---|---|
| 2,373,405 | 4/1945 | Lowit | 75/200 |
| 3,409,973 | 11/1968 | Kilp et al. | 75/200 |
| 3,533,782 | 10/1970 | Claus et al. | 75/226 |
| 3,720,551 | 3/1973 | Allen | 75/226 |
| 3,731,050 | 5/1973 | Latour | 75/226 |
| 3,753,704 | 8/1973 | Manilla et al. | 75/226 |
| 3,762,919 | 10/1973 | Daniels | 75/204 |
| 3,776,704 | 12/1973 | Benjamin | 75/226 |

*Primary Examiner*—Brooks H. Hunt
*Attorney, Agent, or Firm*—Barnes, Kisselle, Raisch & Choate

[57] ABSTRACT

The annular space in a doughnut type metal can is filled with metal particles, the can sealed to constitute an annular workpiece, and the piece hot ring-rolled for expansion to an integrated metal ring of comparatively large diameter.

17 Claims, 6 Drawing Figures

METAL RINGS MADE BY THE METHOD OF PARTICLE RING-ROLLING

This is a division of application Ser. No. 374,184, filed June 27, 1973, now U.S. Pat. No. 3,834,003, which is a continuation-in-part of application Ser. No. 303,160 filed Nov. 2, 1972, now abandoned.

BACKGROUND OF INVENTION

Certain claims hereof are subject to a license to the United States Government in that the invention therein described was made in the course of a subcontract with the United States Air Force Material Laboratory.

Particle or powder metallurgy (PM) processes have been proposed for the fabrication and processing of metal parts and products, mainly because of possible economies and desirable characteristics of the product. For example, it has been proposed to encapsulate powdered copper containing oxides within an elongated steel container and hot roll the unit. During this process, the oxides are broken down and oxygen is absorbed by the encapsulating iron shell. The end product, after removal of the shell, is a deoxidized copper strip. Prior PM techniques however, have not insofar as known been successfully used for producing large ring shaped pieces, and particularly rings composed of aluminum, nickel and other alloys.

Rings constitute one of the most basic and versatile industrial shapes; metal rings with flat or contoured surfaces are commercially produced for many industrial applications in sizes ranging up to 15 feet diameter and 2 feet in width. A material part of present ring production, especially rings of alloy composition, is for aerospace applications. An essential requirement here is that the ring retain its mechanical strength and toughness when subjected to high operating temperatures.

Commonly used methods for making large metal rings include casting, ring-forging and ring-rolling. Casting is successfully used for many metals and simple alloys; however, where the alloy composition is complex, large pieces are subject to defects at grain boundaries, non-homogeneity, and other problems resulting in reduced toughness and strength, creep resistance, and the occurrence of incipient melting at temperatures well below the expected solidus temperature for the alloy. Cast aluminum alloy rings for example, are subject to gross macro-segregation.

The ring forging method involves preparing a perforated annular blank from a bloom, and hot ring forging the blank as it is manually rotated on the mandrel of a press or forge hammer. Although ring-forging of complex alloys produces a ring superior in quality to similar cast rings, the method is expensive and involves considerable loss of material in the process.

Ring-rolling is frequently the preferred method for ring fabrication, as the rings can be rolled to a closely controlled profile, the material losses are small and the method is efficient and economical. However, operation within a narrow temperature range is required for all hot ring-rolling of high temperature, high strength super alloys. Material variation of temperature from the set limits results in cracking (high side) or excessive hardness for working (low side). Some alloys are highly prone to crack during ring-rolling due to high tensile stresses generated in the roll gap, i.e. between the driving roll and mandrel. In such cases ring-forging and ring-rolling methods are both used, i.e. prior to ring-rolling a separate ring-forging operation is employed for initially expanding the ring.

The conventional ring-rolling process involves a considerable amount of billet testing and if casting defects are found they must be removed or repaired. Castings of most complex superalloys are non-homogeneous due to segregation of carbides and intermetallic phases. This non-homogeneity results in incipient melting and increased number of rolling stages and intermediate reheating steps; also non-homogeneity narrows the allowable temperature range referred to above for hot working. Therefore, the total time for fabrication of hard-to-work advanced superalloy rings by conventional ring-rolling is high and this is reflected unfavorably in the labor cost. This is even more true as the cross-sectional shape of the ring becomes more complex.

Summarizing, the prior art methods for making metal rings, especially rings of complex alloys, are in general inadequate, expensive or complicated and time consuming. The present invention is concerned with an improved and economical method of making high quality metal rings by particle ring-rolling.

SUMMARY OF THE INVENTION

Generally the method of the invention constitutes ring-rolling a workpiece comprising metal particles encapsulated in a toroid or doughnut-shaped metal container. During rolling, the workpiece is expanded to form a metal ring of the desired diameter, thickness and configuration.

More specifically, a toroidal shaped encapsulating can of selected size and material is fabricated, leaving the top end open. The annular cavity is filled with metal particles of desired composition, either blended or pre-alloyed. The particles may be compacted or otherwise treated within the can to increase density of the particle mass, following which the can may be gas evacuated (or filled with an inert gas). It is then closed and sealed. Where required, the sealed can may be heated for hot-densification under pressure prior to ring-rolling. The can, now an annular workpiece, is ring-rolled at a suitable temperature in one or more stages to produce a sound ring of desired size and configuration.

The invention when carried out under preselected conditions described herein, is economical, efficient and results in a sound product ring having superior mechanical properties at ordinary working temperatures.

The principal object of the invention therefore is an improved method of making large diameter metal rings using particle metallurgy techniques.

A more specific object of the invention is an improved method of the character above, wherein metal particles of desired composition are encapsulated within the annular cavity of a toroid-like metal container, and hot ring-rolled within the container to produce a ring of predetermined size and configuration.

A further and related object of the invention is an improved method of the character above, wherein blended or pre-alloyed metal particles are encapsulated within a ring-shaped container, densified and hot ring-rolled to produce an integrated metal ring that retains physical properties of strength and soundness under comparatively high operating temperatures.

Another object of this invention is to hot ring-roll metal particles encapsulated within a ring-shaped container at temperatures which are above and below the solidus temperature of the metal particles.

Still a further object of this invention is to ring-roll a blend of powders of refractory metal carbides and an iron group metal matrix.

Other objects, features and advantages will appear from the following description with reference to the accompanying drawings.

DESCRIPTION OF THE PREFERRED EMBODIMENT

Figure 1:
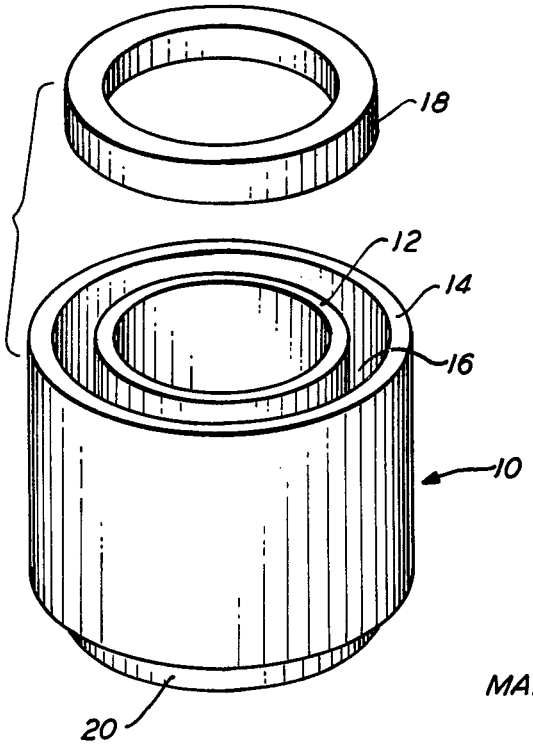
FIG. 1 is an explanatory perspective view of a toroid-like metal container prior to filling with metal particles.
Figure 2:
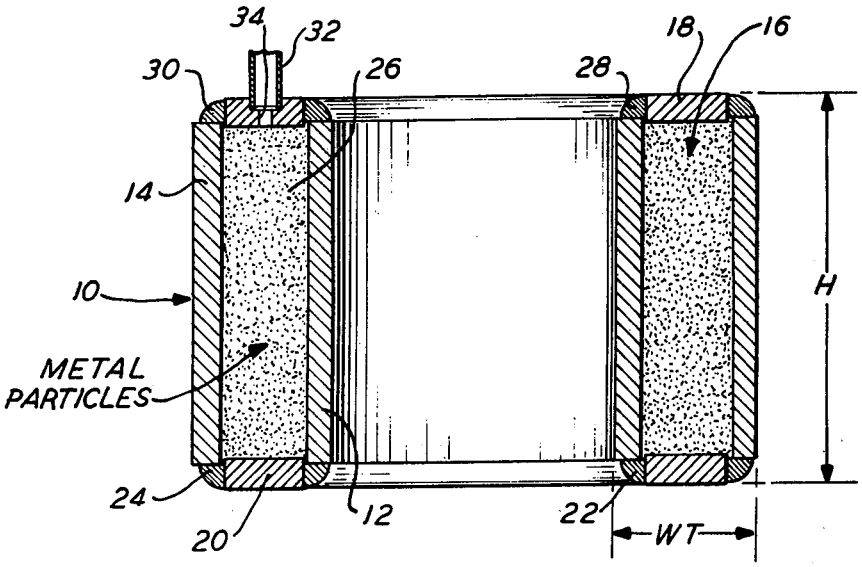
FIG. 2 is a cross-sectional view of the assembled particle-filled container of FIG. 1 with sealed covering.

Referring to FIGS. 1 and 2, the essential structure and techniques for fabricating the toroidal can (annular workpiece) will first be described. FIG. 1 shows the partly assembled workpiece can 10 comprising concentrically positioned inner and outer metal cylinders 12 and 14. The cylinders are of different diameters for defining therebetween an annular space or cavity 16, the top and bottom of which are normally closed by metal ring plates 18 and 20 respectively. In FIG. 1, the ring-plate 18 is for subsequent closure of the top of the cavity, whereas the lower plate 20 is shown as closing the bottom of the cavity. As more clearly shown in FIG. 2, the lower closure plate 20 is peripherally welded to both cylinders at 22 and 24. The cavity 16 is then filled with metal particles 26. The particles as hereinafter described may vary considerably in composition and physical characteristics and preferably substantially fill the annular space. The particles may be in either loose or molded form as preferred, for filling the annular space.

Subject to compacting or otherwise increaseing as required the density of the particle mass before final sealing, the upper plate 18 is welded to the cylinder ends at 28 and 30 in the manner of plate 20 for closing and sealing the top of the cavity. Endplate 18 is provided with a port 34 and tube 32 which will permit the evacuation of the gases from the can and/or the substitution of an inert gas therefore prior to final sealing. Accordingly, the sealed annular workpiece, which in substance constitutes a ring-like mass of metal particles encapsulated in a toroidal metal shell, is adapted as described below, to be mounted on the mandrel of a ring-rolling mill, FIG. 3, for rolling and expansion as described later.

Returning to FIGS. 1 and 2, the configuration of the toroid-like workpiece or can, and the material used in the construction thereof are very important in the successful practice of the invention. In designing the initial can configuration, major factors are (i) the can wall thickness and overall diameter, (ii) the stress distribution during forming, and (iii) the thickness of the inner and outer rims of the can.

The most important workpiece dimension consideration is that the ratio of the internal diameter of the toroid to the thickness thereof be as large as possible. Experience has shown that this ratio can be as low as 1:2 when working with ductile materials. However, when brittle materials such as the superalloys are used the minimum ratio should be 1:1.

Stress distribution within the particle mass should be kept as uniform as possible to obtain a fully diversified ring throughout its cross section. The thickness and shape of end plate 18 and 20 as well as the weld design are important factors in obtaining this result. If these plates are thick they tend to resist the compressive forces applied during the ring-rolling operation. It is believed that the end plates could advantageously be bowed or curved outward from the ring, i.e. convex, to minimize any obstruction to powder consolidation.

The ratio of the thickness of the inner cylinder wall 12 to that of the outer cylinder wall 14 is also important. As the inner cylinder ordinarily will experience more deformation during processing than the outer one it must be thicker initially if the finished ring is to have a wall material skin of equal thicknesses on its inside and outside surfaces. It can be readily shown that the relationship should be as follows:

$$\frac{\text{Inside Wall Initial Thickness}}{\text{Outside Wall Initial Thickness}} \approx \frac{\text{Initial Toroid O.D.}}{\text{Initial Toroid I.D.}} \times K$$

The constant K is normally unity but in those cases where it is desired to have a final product with skins of different thicknesses, it should be altered. K can be expressed in terms of the final ring parameters as follows:

$$K = \frac{\text{Desired Inside diameter skin thickness}}{\text{Desired Outside diameter skin thickness}}$$

It is therefore desirable that the ratio of the thickness of the inner cylinder to the thickness of the outer cylinder be equal to the ratio of the overall outside diameter to the inside diameter, where the final skin thicknesses respectively, are to be substantially equal.

The can material should satisfy the following requirements as closely as possible:

Heat Insulation: The thermal conductivity of the can material should be as low as practical. Preferably, the heat conductivity of the can material should not exceed 0.06 calories/sq. cm./°C/second. As an example of comparatively good heat retaining material, 304 stainless steel has a conductivity figure of but 0.036 calories, as compared with 0.178 calories for low carbon iron (mild steel). This will allow control of hot-working temperatures within the narrow optimum range. This becomes very desirable in fabricating rings of alloys (e.g. one known by the trademark IN-100) which can be fabricated only within a very narrow temperature range. A further advantage is that less can material is required.

Coeficient of Expansion: As the final ring diameters are usually large (e.g. greater than 2 ft.) large differences in the coefficients of expansion will result in relatively large thermal stresses. In some cases, these stresses may cause separation of the can material from the particle mass. It is also possible that internal crack nucleation and propagation can occur within the particle mass. It is generally desirable to select materials having similar coefficients of expansion. The ideal situation is where the coefficient of expansion of the outer cylinder material is greater than that of the particle mass, which in turn is greater than that of the inner cylinder material. This ensures desirable compressive thermal stresses during cooling after ring-rolling.

Weldability: It is desirable that the can is easily welded with the strength of the welds at the end plates being sufficient to eliminate the possibility of weld cracking during ring expansion and fabrication.

Flow strength: The flow strength of the can material preferably should be nearly equal to the flow strength of the fully dense particle mass at the ring-rolling temperatures. This will minimize the hazard of can opening or cracking during hot ring-rolling and will allow the transfer of applied forces to the particle mass more effectively.

Oxidation Resistance: This characteristic is important in order to minimize metal loss during heating in gas-fired furnaces, for example without the use of highly protective muffles. It is also desirable that the can material be oxidation resistant to avoid the need for protective atmospheres.

Cost: The can material should be readily available and inexpensive.

In selecting the metal particles, the following factors must be considered:

Shape, Size and Distribution: If possible, the particles should be irregular or angular (grit-like) in shape. Such particles are more compressible and more easily sintered than spherical ones. Furthermore, the particle size, size distribution, and shape should provide maximum packing density with or without compaction. In this regard, angular and spherical particles have about equal application.

Composition: Pre-alloyed particles are, as a rule, preferred. In certain cases, however, blended particles of different compositions may be more desirable since they are usually more compressible, more economical, and more easily sintered to the desired density and strength levels. During ring-rolling, there is a considerable amount of hot deformation and as a result homogenization can take place. Blending also opens the way for producing multiphase, composite rings with a wide range of physical and mechanical properties.

Internal Friction Coefficient: A high internal friction coefficient of the particle mass will increase the mass consolidation rate during ring-rolling by restricting the movement (mobility) of the particles. Internal friction is generally increased by the use of blended compositions wherein the particles are of irregular shapes and have high sintered strength and also by the use of high ring-rolling temperatures.

Processing Prior to Ring-Rolling

The assembled workpiece shown in FIG. 2, may, depending on the materials used in the workpiece and the desired characteristics of the product ring as well as other factors, be subject to one or more process steps prior to hot ring-rolling. For example, gases in the particle-filled cavity can be removed where desired by a vacuum pump (not shown) through the tube 32 and vent opening 34 in the top ring plate 18. The vent tube is suitably sealed off after evacuation. If desired, an inert gas may be introduced into the particle mass prior to sealing of the vent tube.

Some densification of the particle mass is generally desirable prior to ring-rolling to impart some tensile strength to the sintered particle mass. The minimum tensile strength should be at least equal to the tensile stresses generated at the roll gap during the ring rolling. Some of the softer and easily sinterable materials such as copper may not require any pre-compaction, and direct sintering will produce sufficient consolidation before hot ring-rolling. However, if the particles are not easily sinterable, a densification step may be necessary. Any of the well known hot or cold densification techniques can be used for giving the particle mass added tensile strength.

Particle Ring-Rolling (PRR) Criteria

Figure 3:
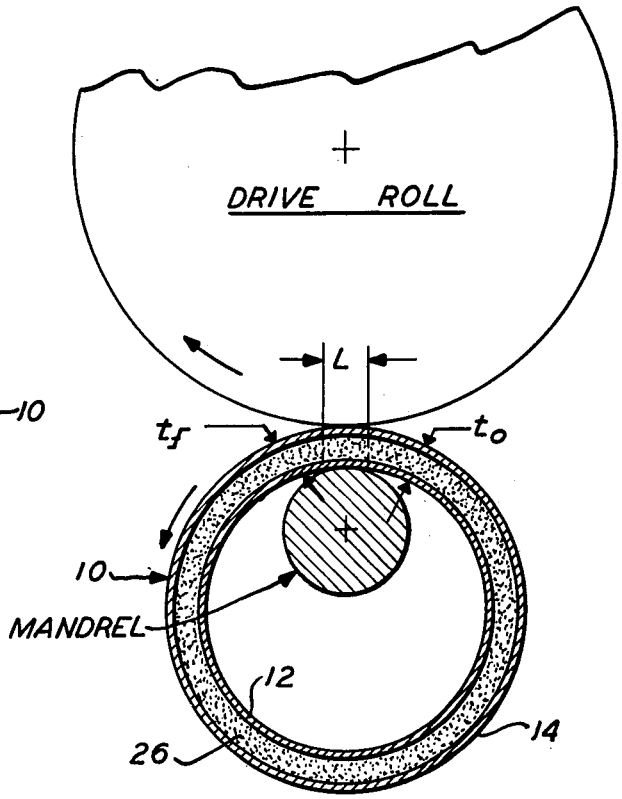
FIG. 3 is a simplified view of a ring-rolling mill with the container and encapsulated powder in process of ring-rolling in accordance with the present invention.

FIG. 3 shows a conventional form of simple ring-rolling mill wherein the workpiece 10 is rolled between the MANDREL and the powered DRIVE ROLL as indicated by the direction arrows, for expanding the workpiece 10 into a ring. In the present invention, the process initially is generally the same as conventional ring-rolling; however, the present invention essentially differs therefrom by processing a particle mass rather than a solid article.

It is understood of course that the ring-rolling mill of FIG. 3 is shown by way of example only, and that different forms of known ring-rolling equipment such as free roll and trap set-ups, multiple rolls, etc. can be used where suitable in practicing the invention.

In the ring-rolling step of the process, the maximum possible compressive stresses must be applied with minimum possible resultant tensile stresses, and at a temperature compatible with the properties of the specific particle and can material employed. The tensile stresses that can be tolerated during ring-rolling are greatly dependent upon the tensile strength of the encapsulated sintered particle mass.

The tensile stresses depend, among other things, on the mandrel diameter and the ring thickness of the particle mass. The larger the diameter of the mandrel and the smaller the particle ring thickness, the lower the resultant tensile stress in the roll gap during ring-rolling. This also means a higher ratio of compressive stress to resultant tensile stress. Under such conditions, the present process can be made to approach the extrusion process, where compressive stresses predominate.

The tensile strength of the sintered particle mass depends upon the particle size, shape, composition, and the particle densifying and sintering operations, if the latter are used prior to ring-rolling. The higher the tensile strength of the sintered particle mass, the less stringent are the critical requirements with respect to the ring-rolling variables. Stated differently, the more closely controlled the encapsulating can design and the rolling variables, the less the need for densification prior to ring-rolling.

The following is a qualitative analysis primarily for the purpose of bringing out the main process features of ring-rolling a toroidal particle mass, or toroidal workpiece, essentially composed of sinterable particles.

Figure 3A:
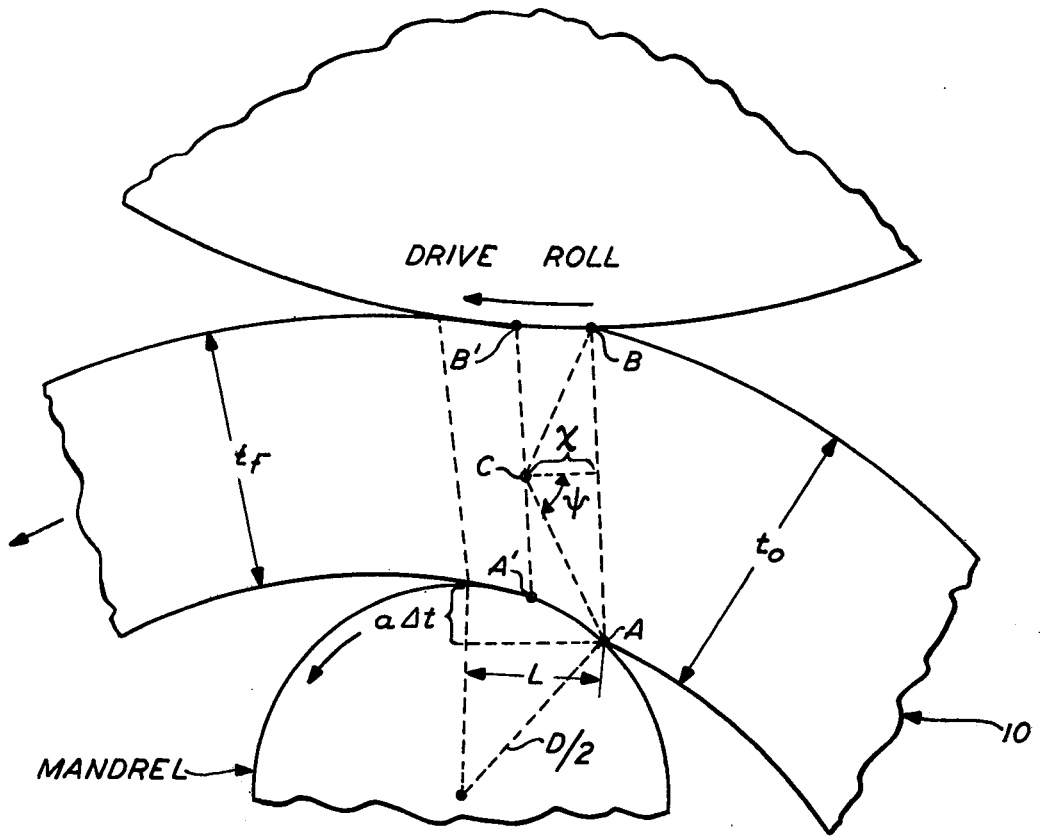
FIG. 3A is an enlarged, partly diagrammatic view of the roll gap region of FIG. 3 during a roll pass.

Referring particularly to FIGS. 3 and 3A, examination of the roll gap between the mandrel and drive roll reveals that the length (L) of contact between the ring and the mandrel can be shown from the diagram of FIG. 3A to be approximately:

$$L = \sqrt{aD(t_o - t_f)} \quad \text{(Equation I)},$$

where

D is the mandrel diameter, $t_o$ is the ring thickness prior to roll pass, $t_f$ is the ring thickness after roll pass, and $a$ is a working constant, depending upon the relationship of the diameter of the drive roll to that of the mandrel.

In practice, the constant $a$ may range between 0.5 and 1.0, the former value applying where the drive roll and mandrel diameters are equal and the internal diameter of the ring (workpiece) is considerably larger than that of the mandrel. However, where the roll diameter is considerably larger than that of the mandrel, as in the usual case, the constant $a$ approaches 1.0.

Now, let it be assumed that the thicknesses of the outer and inner walls of the workpiece are considerably less than $t_o$ so that the canning material simply functions as a carrier of the particle mass into the roll gap. The particle mass is thus drawn into the roll gap at points A and B so as to pass progressively through various stages of densification. Corresponding reduction in thickness of the workpiece takes place, the thickness being $t_f$ as indicated, at the end of the roll pass.

The particles along the line AB are not subject to compacting pressure until they pass line A'CB' which as measured from the mid-point of line AB, is distance $x$ therefrom. It can be shown that the approximate value of $x$ is:

$$x = t_o/2 \tan \psi \quad \text{(Equation II)}.$$

Obviously, compaction during rolling requires that: $x < L$, so that from Equations I and II, $$t_o/2 \tan \psi < a D (t_o - t_f),$$

or $$\frac{D}{t_o} > \frac{t_o}{4a\Delta t \tan^2 \psi} \quad \text{(Equation III)},$$

where $\Delta t = t_o - t_f$ and $$\psi\ 45° + \alpha/2, \quad \text{(Equation IV)}$$

$\alpha$ being the angle of internal friction of the particle mass.

Typical values of $\alpha$ are given as follows:

Case I: 10° to 20° for hard, uncompacted, spherical and free flowing powder particles such as superalloys;

Case II: 40° to 60° for irregular, uncompacted powder particles of ductile metals and alloys of Al, Ni, Cu, Fe, etc.;

Case III: 60° to 80° for a highly predensified mass of ductile metals and alloys of Al, Ni, Cu, Fe, etc.

Assuming (1) a practical working constant 0.75 for $a$, and (2) indicated case averages for angle $\alpha$ in Equation IV, so that $\psi$ for Cases I, II, and III becomes 52.5°, 70° and 80° respectively, then according to Equation III, the ratio of mandrel diameter to pre-rolled ring thickness ($D/t_o$) can now be expressed in comparative sense as follows:

$$\text{Case I:} \quad \frac{D}{t_o} > \frac{t_o}{5\Delta t} \quad \text{(Equation V)};$$

$$\text{Case II:} \quad \frac{D}{t_o} > \frac{t_o}{22\Delta t} \quad \text{(Equation VI)};$$

$$\text{Case III:} \quad \frac{D}{t_o} > \frac{t_o}{171\Delta t} \quad \text{(Equation VII)};$$

For example, in a specific ring-rolling pass wherein $t_o/\Delta t$ is 10 (e.g. $t_o = 2.0$ in. and $\Delta t = 0.2$ in.), Equations V, VI and VII above, show that $D/t_o$ for Cases I to III would exceed values 2.0, 0.45 and 0.06, respectively.

Generalizing for typical ring-rolling operations of the character in question, $t_o/\Delta t$ varies between 5 and 10. $D/t_o$ then falls approximately within the range of 1 to 4 for Case I, 0.2 to 1.0 for Case II, and 0.03 to 0.2 for Case III. The $D/t_o$ ratios given above represent absolute minimums for the case assumptions described. The optimum value of $D/t_o$ will depend in a given working upon the degree of compaction per roll pass desired, and the tensile strength, pore size and volume, particle size and shape, and flow stress of the particle mass in the encapsulating ring.

For a particle mass made from relatively soft, irregular, fine and compacted particles (e.g. copper) which has high ductility, large angle $\alpha$, and is readily deformable at high temperatures, i.e. Case III, the optimum minimum ratio $D/t_o$ is but slightly more than that shown in the example for Equation VII. Emperically, a value 0.2 for $D/t_o$ is found to be adequate here where $t_o$ is 2 in. and $\Delta t$ is 0.2 in.

For less ideal particles such as super-alloy powders, which are hard, non-compactible at room temperature and spherical, the optimum $D/t_o$ value may necessarily be above 5, for the given examples of $t_o$ and $\Delta t$ above. For such particles, experience has shown that a hot densification step is highly desirable for increasing the tensile strength and angle $\alpha$ of the mass prior to hot rolling; this brings the optimum ratio $D/t_o$ to approximately 2 or thereabout. During hot rolling, minimum heat loss through the can material and effective stress transmission to the particle mass are very desirable; also, advantageous techniques that can be used here include trap ring-rolling (with contoured drive wheel and mandrel), or the standard four-roll machine for additional compaction near the edges of the ring.

The basic process of the invention, together with optional steps that can be added as required, includes the following:

a. Preparing a toroid or doughnut-shaped can of suitable material with one end open;

b. Filling the annular space or cavity of the can with metal particles of desired composition, in either loose or pre-molded form;

c. Tapping, compacting, sintering and/or refining the particle mass in the can;

d. Sealing the can with or without prior gas evacuation, or filling with an inert gas as a protective atmosphere;

e. Optionally hot-densifying the particle mass while in the can before or after sealing;

f. Ring-rolling the filled and sealed can at suitable temperature in one or more stages to produce a sound ring of the desired size, configuration, and micro-structure;

g. Optionally heat-treating the ring to optimize its properties;

h. Optionally removing the can material by machining, oxidation, pickling or by other methods prior to final machining.

All heating and working of the workpiece is done while the particle material is in the can. It is thus protected from atmospheric contamination at high temperatures during ring fabrication. Furthermore, the can metal tends to develop a metallurgical bond with the consolidated particle mass during ring-rolling, which in turn tends to reduce the nucleation and propagation of surface cracks during rolling.

A number of rings were made in accordance with the invention, using different materials as described below.

ALUMINUM

Several rings were made with Al and Al alloy known by the alloy grade designation 2219 particles, the latter having a large freezing range. Five toroid-shape cans containing the particles were constructed and prepared as listed in Table I below; the cans were subsequently ring-rolled with results listed in Table II.

Table I describes the five cans which were made from 6061 Al alloy pipes and plates (all ¼ in. thick). For welding, type 4043 wire was used. The dimensions of all the cans prior to filling with powders were 5 in. ID, 12 in. OD, 3½ in. wall thickness (WT), and 7 in. height (H). All were compacted at room temperature. The first four cans were hot ring-forged at 800°F prior to ring-rolling.

TABLE I

| Can No. | Powder Composition | Powder Blend | | Theoretical Compacted Density | Alcan Dimensions (in.) After Forging (800°F) ID | OD | H |
|---|---|---|---|---|---|---|---|
| 1 | Al | Alcoa 130 | (50%) | 80% | 8.4 | 13.4 | 7.2 |
| | | Alcoa 129 | (35%) | | | | |
| | | Alcoa 1202 | (15%) | | | | |
| 2 | Al | Alcoa−6+20 | (40%) | 83% | 8.6 | 13.6 | 7.4 |
| | | Alcoa 130 | (30%) | | | | |
| | | Alcoa 129 | (20%) | | | | |
| | | Alcoa 1202 | (10%) | | | | |
| 3 | Al | Alcoa 129 | (100%) | 78% | 8.2 | 13.2 | 7.2 |
| 4 | 2219 | Reynold −6+20 | | 78% | 6.2 | 12.2 | 7.2 |
| | | Alcan | (25%) | | | | |
| 5 | 2219 | Alcan | (100%) | 72% | | | |

Note:
Sample 1 did not crack, nor did it open at any weld; Samples 2 and 3 each had a transverse crack, and in Sample 4 the bottom weld opened at three points.

Table II

| Sample No. | Start Temp. F° | Upset to (in.) | Trap Used During Rolling | Rolled Down to WT (in.) | Remarks |
|---|---|---|---|---|---|
| 3 | 800–825 | 6.7 | Yes | 2 | Three large transverse cracks |
| 2 | 800–825 | 6.7 | Yes | 2 | Two large transverse cracks |
| 1 | 850–875 | 6.7 | Yes | 2.2 | No cracks |
| | 850–875 | 6.7 | Yes | 1.6 | |
| | 850–875 | None | None | 1.0 | Very good |
| 4 | 750 | None | None | 2.5 | Weld Opened |
| 5 | 750 | None | None | 2.5 | Inside weld opened |

Note:
A 7-in. mandrel was employed throughout except with sample 5 where a 4¼ in. mandrel was used.

Ring-rolling was done in a conventional ring-rolling machine as described above. As indicated, sample No. 1 ring-rolled the best. Its final dimensions were: 31.2 in ID, 33.2 in. OD, 1 in. WT and 7 in. H. The ring gave the typical metallic sound of Al when struck, and ultrasonic testing showed no flaw. The ring was machined, polished and examined visually for cavities or porosity. None was found. Samples 2 and 3 were the next best, followed by Nos. 4 and 5 in descending order. These latter samples with alloyed powders (Table I), could have been improved by more closely following preferred procedures listed above, i.e. especially by making the weld stronger, by applying uniform prior compaction, by using a higher ring-rolling temperature, and by using a larger mandrel diameter or smaller wall thickness prior to ring rolling, i.e., greater $D/t_0$ ratio, referring to FIG. 3A:

An additional can processed in a manner similar to Sample 1 was cut into sections and machined to obtain tensile specimens of ½ in. gauge length and ⅛ in. diameter. The mechanical properties of the hot-rolled piece and of various equivalent standard wrought Al are given in Table II*a* below.

TABLE IIa

| | Comparative Properties of Hot-Rolled Al Particle Strip and Wrought Al | | | | |
|---|---|---|---|---|---|
| | Hot-Rolled From Al Powders | Wrought 1060-Al (H-0) | Wrought 1060-Al (H-18) | Wrought 1100-Al (H-0) | Wrought 1100-Al (H-14) |
| Tensile Strength (psi) | 18,400 | 10,000 | 19,000 | 13,000 | 18,000 |

TABLE IIa-continued

| | Comparative Properties of Hot-Rolled Al Particle Strip and Wrought Al | | | | |
|---|---|---|---|---|---|
| | Hot-Rolled From Al Powders | Wrought 1060-Al (H-0) | Wrought 1060-Al (H-18) | Wrought 1100-Al (H-0) | Wrought 1100-Al (H-14) |
| Elongation | 30% | 43% | 6% | 35% | 9% |

The properties of the hot-rolled Al particle product are thus shown to be as good as those of the corresponding wrought product; also the sample tests described clearly indicate that the particle ring rolling process is economically and technically practical in the production of Al-base rings.

NICKEL

The PRR process was shown to be applicable as well to nickel alloys. Nickel rings were fabricated from two different nickel powders, namely those known by the trademarks Inco 123 and Alcan MD101. The former is fine (4–7 micron size) carbonyl nickel powder with about 2.5 gms/cc fill density. The latter is relatively coarse (−100 mesh) nickel particles with about 4 gms/cc fill density. The particle-containing sample cans were made from 1018 steel seamless pipes with ½ in. wall thickness and 1025 steel (½ in. thick plates), as illustrated in FIG. 2.

The Ni particles were compacted to increase the density and interparticle contact area, and then were heated to develop some sintered tensile strength prior to ring-rolling. The cans were also evacuated of gas prior to sealing.

Relevant data on the two sample cans are given in Table III, and details of heating and ring-rolling are given in Table IV below. The cans were heated at 2150°F for one hour prior to ring-rolling. A free roll set up was used with a 4 ⅜ in. diameter mandrel. In the first rolling stage, the can thickness decreased from 2-½ in. to about 1-½ in. and the ID increased from 5 to about 10 in. The rings were reheated for a few minutes at 2150°F and ring-rolled a second time using 4-⅜ in. mandrel to the dimensions shown in Table IV. Both rings rolled without any difficulty.

TABLE III

| Ring No. | Nickel Powder Description | Steel Can Dimensions (in.) H | OD | ID | Weight (lbs) | Compacting Pressure (TSI) | Compacted Density (g/cc) | Compacted Density % Theory |
|---|---|---|---|---|---|---|---|---|
| 1 | Inco 123 | 6.9 | 10 | 5 | 94 | 17 | 5.1 | 57 |
| 2 | Alcan's MD 101 | 6.9 | 10 | 5 | 99 | 17 | 6.0 | 67 |

TABLE IV

| | Ring-Rolling of Ni Particles | | | | | |
|---|---|---|---|---|---|---|
| | | | No. of | Final Dimensions (in.) | | |
| Ring No. | Start Temp. F° | Time (hrs.) | Rollings | OD | ID | H |
| 1 | 2150 | 1 | 2 | 25.8 | 24.5 | 6.5 |
| 2 | 2150 | 1 | 2 | 22.1 | 20.8 | 7.4 |

A portion of the Ni-Ring-1 was cut off for mechanical testing. The mechanical properties were measured on round tensile specimens 1 in. in gauge length and 0.252 in. in diameter. The properties are given in Table IV*a* below along with those of wrought nickel products of similar composition.

TABLE IVa

| | Particle Ring-Rolled Ni | Wrought Ni (average of 200, 201, 205) Annealed Hot Rolled Rod |
|---|---|---|
| Ultimate Tensile Strength | 64,080 psi | 63,000 psi |
| Yield Strength (0.2 Offset) | 24,848 psi | 20,000 psi |
| Elongation | 49% | 50% |

For the same amount of elongation, the PRR processed Ni shows slightly higher ultimate tensile strength and yield strength values. The good results of the ring-rolling of nickel particles are closely related to the following factors:

a. The nickel particles were relatively fine, and irregular, and compacted to give 57–67% density and large contact area between particles. Heating the nickel particles in the can at 2150°F for 1 hour is considered to have given considerable tensile strength to the sintered particle mass. In other words, the internal friction angle for the sintered particle mass is very high, noting Case III. The minimum $D/t_o$ ratio here, is rather low, i.e. about 0.2 or less. However, in this ring-rolling example, $D/t_o$ is about 2.9, well above the minimum value.

b. The tensile stresses generated at the roll gap were lower than the tensile strength of the sintered particle mass due to flow of Ni at 2150°F.

c. In the final ring-rolling pass at 2150°F, the $D/t_o$ ratio increased to about 7 which further improved the quality of the ring.

INCONEL 718

Several superalloy rings were made using a particulate metal known by the trademark Inconel 718 (hereinafter sometimes called "Inconel") comprising prealloyed particles made by Whittaker Corp. Inconel 718 has the following composition: Ni=52.5%, Cr=19.4%, Fe=18%, Cb+Ta=5.1%, Mo=3%, Ti=0.9% Al=0.6% and C=0.08%. The particles were −35 + 325 mesh and almost perfectly spherical. Apparent density is 4.94 gms/cc. No binders of any sort were used with the particles, which were extremely hard, and room temperature compaction was therefore impossible.

These Inconel particles are hard not only at room temperature but also at elevated temperature and as they are coarse and spherical, they are not easily sintered. They are further characterized by high flow strength (even at elevated temperatures), mobility, a high minimum $D/t_o$ ratio, and low sintered tensile strength.

The data on canning and ring-forging prior to ring-rolling of the Inconel particles are given in Table V below.

TABLE V

| Sample No. | Powder Weight (lb.) | % Powder Packing Density (Theoretical) | No. of Ring-Forge | Dimensions After Ring-Forging (in.) H | OD | ID | WT |
|---|---|---|---|---|---|---|---|
| 1 | 41.2 | 66.2 | 0 | | | | |
| 2 | 41.2 | 66.2 | 0 | | | | |
| 3 | 42.0 | 67.3 | 3 | 6.7 | 17 | 15 | 1.0 |
| 4 | 42.0 | 66.5 | 2 | 6.7 | 12.2 | 8.8 | 1.7 |
| 5 | 42.0 | 66.5 | 0 | | | | |
| 6 | 33.3 | 69.2 | 0 | | | | |

The initial can dimensions in inches were as follows:

| | | | | |
|---|---|---|---|---|
| Samples 1–5: | 6.9 | 10 | 5 | 2.5 |
| Sample 6: | 5.5 | 10 | 6.5 | 1.7 |

The design, preparation and filling of the first five sample cans with Inconel 718 particles were generally similar to those for nickel particles, except that there was no room temperature compaction. The total weight of each filled can was approximately 95 lbs., i.e., 53 lbs. of steel can material (½ inch thick 1018 or 1025 grade steel) and 42 lbs. of Inconel 718.

Cans 3 and 4 were ring-forged at 2200°F for determining the effect of hot-densification prior to ring-rolling. Sample 3 was ring-forged in three stages and reduced to the final dimensions given in Table V. Due to prolonged heating in a nonprotective atmosphere, about 12% of the steel was lost by oxidation. Sample 4 was ring-forged in two stages to a lesser degree and reduced to the final dimensions also listed in the Table. The steel loss was about 6%.

Can 6 was made from ¼ inch thick Inconel 718 plate with overall inner diameter-to-wall thickness ratio larger than that of the steel can samples. The can was evacuated and welded shut with an Inconel filler rod. Inconel was also used as can material to determine whether its higher strength is helpful in transmitting the applied stresses to the particle mass during ring-rolling.

Data on the ring-rolling of Inconel 718 particles are given in Table VI below.

TABLE VI

Particle Ring-Rolling Of Inconel 718 Particles

| Sample No. | Start Temp. (F°) | No. of Ring Rollings | Dimensions of Final Ring (in.) H | OD | ID | Observations During Rolling |
|---|---|---|---|---|---|---|
| 1 | 2100 | 4 | 7.2 | 26.5 | 25.2 | Can looked excellent. |
| 2 | 2100 | 4 | 5.7 | 28.8<br>27.7 | 27.0 | Can looked excellent. |
| 3 | 2180 | 2 | 6.9 | 22.2 | 20.5 | Crackling noise. Cracked lengthwise. |
| 4 | 2180–2120 | 3 | 6.9 | 25.5 | 24.0 | Looked excellent until it cracked lengthwise. |
| 5 | 2180–2100 | 3 | 7.2 | 35.0 | 34.0 | Can looked excellent. |
| 6 | 2200–2100 | 4 | 6.2 | 23.5 | 22.5 | Initially excellent, until it cracked lengthwise on one spot. |

All samples were heated in a gas-fired furnace. The temperature was varied between 2100° and 2200°F. Time at temperature was 1 hour for the first three samples and 2 hours for the last three samples shown in Table VI. Sample 2 was ring-rolled to give it a contour profile. All others were flat ring-rolled.

All of the free ring-rolling was done with a 4¾ in. diameter mandrel. When a trap was used as for samples 3 and 4, the mandrel diameter was 8 in. Each sample of Table VI was ring-rolled in 2 to 4 stages, with intermediate short soaking periods (at temperatures indicated), before final dimensions were reached. The following observations were made:

Sample 1: Considering the very limited soaking time and temperature (1 hour at 2100°F) before the first ring rolling stage, the strength of the particle mass under such mild sintering was accordingly very low. Soaking time between the subsequent three rolling stages was also very low, never more than a few minutes at 2100°F. The mandrel diameter was 4.75 in. The ratio $D/t_o$ was initially about 3 and gradually raised to about 9 near the end of the 4th (final) rolling stage. When the ring was saw-cut and examined after final rolling, the particles were loose, showing little cohesive strength and very little deformation. For such a case, a minimum $Dt_o$ ratio of at least 5 is expected at the beginning of ring rolling, to be gradually raised to above 15 or thereabout near the end of rolling. The steel can did not develop cracks and the can welds were intact.

Figure 4:
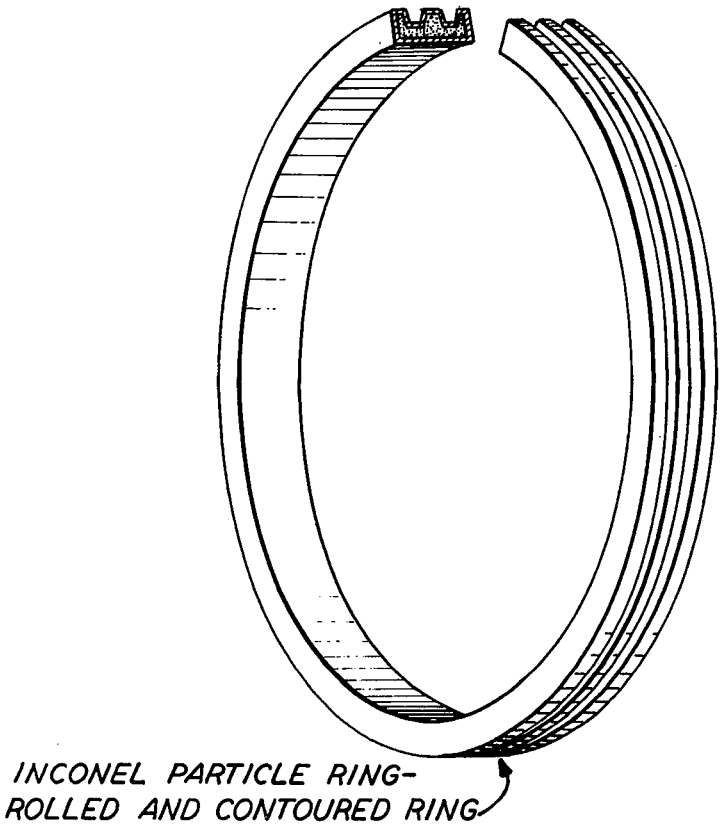
FIG. 4 is a view of a super-alloy ring made according to the invention, showing a contoured profile at a test cut in the ring.

Sample 2: This sample was ring-rolled in the same manner as sample 1 except for contouring during the last (4th) rolling stage. Its appearance after rolling was good; there were no visible cracks either in the steel shell or welds. The profile is readily contoured. The rolled ring (as-cut) and the contoured profile are shown respectively in FIGS. 4 and 5. The ring wall thickness is about 0.9 in. at the ridges and about 0.36 in. at the two intermediate sections, FIG. 5.

Figure 5:
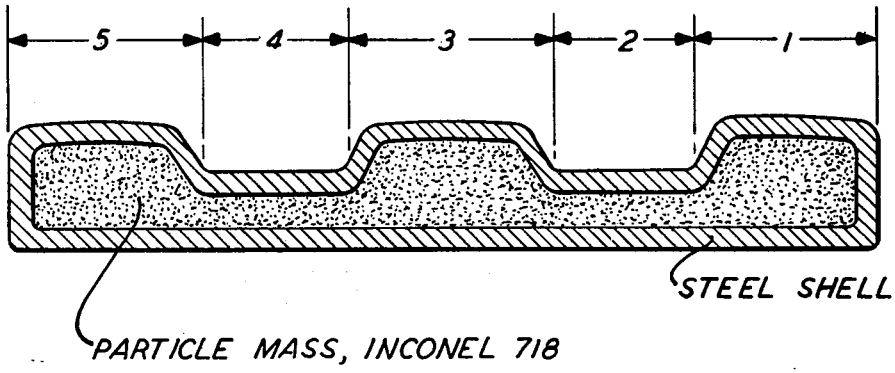
FIG. 5 is an enlarged cross-sectional view of the ring shown in FIG. 4.

Metallographic examination of the ring sections 1 to 5 in FIG. 5 showed that the Inconel particle mass was densest in sections 2 and 4, less dense in section 3, and least dense in sections 1 and 5. The variations in section densities are explained as follows:

Initially, the $D/t_o$ ratio is approximately 3. The ratio gradually increases to about 6 by the time the third ring-rolling stage is completed. Sample 1 teaches that in all probability no significant densification has taken place so far. During the 4th ring-rolling stage, the drive roll was fitted with a contoured ring to give the cross-section shown in FIG. 5. As the contour ring-rolling stage is completed the $D/t_o$ ratio at sections 2 and 4 is approximately 30, whereas the ratio at sections 1, 3 and 5 is only about 10. The higher $D/t_o$ ratio at sections 2 and 4 explains the greater densification.

Sections 1 and 5 have the same $D/t_o$ ratio as section 3; however, the applied stresses transmitted to the particle masses in sections 1 and 5 are probably considerably less than those transmitted to the section 3 mass because of the steel end plates. This would account for the densities in sections 1 and 5 being lower than in section 3.

This suggests that the top and bottom can plates by thinner and bowed outward; this configuration would transmit stresses to the particle mass more uniformly and effectively. Also, the use of a four-roll machine could provide more uniform compaction, i.e. increase densities at top and bottom of the ring. For contouring or complex shaping of the ring, it is desirable that the inner and outer circumferential walls of the can be reasonably close to the shape of the finally rolled cross-section.

Sample 3: As shown in Table V, this sample was ring-forged to a considerable degree for determining the effect of hot-densification prior to ring-rolling. The ring-rolling operation was carried out at a starting temperature of 2180°F. After relatively brief rolling, the steel can opened up at several spots along the length of the ring. Failure was directly related to weak regions in the can caused by approximately 20% weight loss of the steel shell during heatings prior to ring-forging and ring-rolling due to oxidation. Non uniform thickness of the steel shell developed during ring-forging, and non uniform densification of the Inconel particle mass was due to improper ring-forging.

However, there were numerous regions within the ring showing satisfactory densification of the Inconel 718 particles, thereby indicating that further improvement of the hot densification step would result in a rolled ring of high density throughout.

Sample 4: This sample behaved like sample 3, except that the can shell opened lengthwise to a lesser degree, and then only during the last stage of ring-rolling. Sample 4 was ring-forged considerably less than sample 3. This resulted in less weight loss of the steel shell due to oxidation; furthermore, the can shell thickness remained more uniform. After rolling, examination showed densification in several regions of the ring.

Sample 5: This sample was rolled in the same manner as sample 1. The can was not ring-forged prior to ring-rolling. The soaking temperature was lowered to 2120°F during the subsequent two rolling stages. The steel can and the welds came through the ordeal intact even though the final ring inner diameter was 34 in., considerably larger than any other rolled rings. This clearly shows that the steel shell can withstand temperatures at least up to 2120°F. The rolled ring was saw-cut and examined for densification of the Inconel particles. Densification was poor, due most likely to low temperature (2120°F.) in the last two rolling stages, and to a low $D/t_o$ ratio. Initially, $D/t_o$ was only about 3. Only near the last stage did $D/t_o$ reach 12, which was probably too low for the lower soaking temperature.

Sample 6: In this sample the can shell was fabricated from Inconel 718 plate instead of carbon steel. Shell thickness was ¼ inch instead of ½ inch as in the other cans. The overall wall thickness was smaller, and the $D/t_o$ ratio (approx. 15) was higher during the last rolling stage. It was ring-rolled at higher average temperatures than the others. Only during the last of the four rolling stages did the ring crack lengthwise at one spot. As to overall densification, this sample was the best. A metallographic examination of the cross-section showed that the density of the Inconel particle mass was nearly 100% in the center section and gradually decreased with increasing distance from the center. The greater heat insulation of the Inconel shell material and improved stress transmission to the powder through the relatively thin shell, coupled with higher average ring-rolling temperatures, contributed to greater success with this sample. From the above, it is seen that increasing the mandrel diameter during final rolling stages could have produced a ring with 100% densification throughout.

PARTICLE RING-ROLLING OF REFRACTORY METAL CARBIDES IN A GROUP VIII A METAL MATRIX

Rings consisting of finely-divided carbide particles of the refractory metals, i.e. titanium, tungsten and vanadium bonded together by a Group VIII A metal, iron group, i.e. iron, nickel and cobalt are commercially desirable products.

A ring consisting, of titanium carbide in a ferrous matrix was obtained by ring-rolling a toroid containing TiC pre-alloyed powder and a steel powder.

The toroid or doughnut-shaped can was prepared in the following manner:

Can material: Inconel

Can dimensions: Height - 5.85 inches, O.D. 11 inches, I.D. 6 inches

Powder weight: 25.9 lbs.

Compacting Pressure: 3.1 tons/in$^2$

Compacted Density: 3.11 gms/cc or 47%

Total weight (powder and can): 70.25 lbs.

Powder characteristics:

The powder used to produce this ring was manufactured by the Sintercast Division of Chromalloy American Corporation and sold under the Trademark FER-RO-TiC, Grade C. This powder was a blend of 45% titanium-carbide (volume) and medium alloy tool steel.

Prior to compacting in the can, the as-received blended powder was hydrogen treated at 2150°F for 40 minutes, in order to lower the oxygen level. The levels of carbon, oxygen and hydrogen after this treatment were 6.83%, 0.706% and 0.0079%, respectively.

After the powder was compacted the exposed annular portion of the can was covered by welding a stainless steel cover to the body of the can.

The annular interior of the can was then evacuated and simultaneously heated at 550°F for approximately 6–8 hours.

The sealed can was ring-rolled in the following manner with a 42" drive roll and no trap:

| Rolling Program | Mandrel Dia. (in.) | Temp. (°F) | Dimension (in.) OD | ID | H | Remarks |
|---|---|---|---|---|---|---|
| 1st | 5-1/2 | 2160 | slightly changed | | | |
| 2nd | 5-1/2 | 2160 | 11-3/4 | 8-3/4 | 6 | Rolling satisfactory |
| 3rd | 7 | 2160 | 15 | 13 | 6-1/4 | " |
| 4th | 7 | 2160 | 17-1/2 | 16 | 6-1/4 | " |
| 5th | 8 | 2160 | 20-1/2 | 19 | 6-1/2 | Can started to crack and welds opened up |

After each rolling the ring was re-heated to 2160°F for 5 to 10 minutes.

Product Evaluation

Hardness: $R_c$ 50; Density: 6.1 gm/cc or at least 92.5% theoretical density; Metallographic examination: (a) TiC particles — fine and uniformly distributed throughout matrix; (b) Microstructure appears dense and well consolidated; and (c) Carbide particles were satisfactorily "wetted" by the ferrous matrix.

These properties show that a satisfactory product was obtained. The product has achieved a desirable hardness level and degree of uniformity.

The hereinbefore ring was obtained by ring-rolling a carefully prepared can in the solid state, i.e. at a temperature below the solidus temperature of the metal matrix material. This ring could also have been obtained by ring-rolling the can at a temperature above the solidus temperature of the metal matrix material. Ring-rolling conducted at a temperature wherein the matrix material is at least partially in the liquid state offers the following advantages over ring-rolling a similar can in the solid state: (a) less force is required for deformation, thereby enabling larger rings to be rolled, and (b) satisfactory "wetting" of titanium carbide particles by the ferrous base matrix is assured. This provides improved bonding at the carbide metal matrix interface.

Particle Ring Rolling of Ti-Base Particles

Ring-rolling of Ti or Ti-base particles present no technical difficulties. Unlike the superalloy powders, Ti and Ti-base particles are compressible at room temperature. The procedures developed for ring-rolling of Al and Ni particles described above are considered completely adequate for producing Ti and Ti alloy rings using the particle ring rolling process of the invention.

The process invention is well suited to many other combinations of particle materials and encapsulating cans for making special rings, including the following:

PARTICULATE MATERIAL KNOWN BY TRADEMARK NITINOL, IN A TITANIUM CAN

After ring-rolling, the Ti remains outside with the NiTiNol particle mass inside. This provides the corrosion resistance of Ti and the "memory" properties of NiTiNol inside. NiTiNol material filling the can is in the form of either blended or pre-alloyed particles.

TITANIUM-BERYLLIUM PARTICLES IN TITANIUM "CAN"

Ti on the outside provides corrosion resistance. This titanium-beryllium composite, in which the beryllium to titanium ratio could be higher than in conventional titanium-beryllium composites, provides the high strength to-density ratio. This combination has unique potential in the manufacture of rings for high speed aircraft.

COPPER PARTICLES IN TITANIUM CAN

This combination provides the optimum combination of corrosion resistance and heat conductivity. Depending upon the fabrication approach used, different sizes and shapes are obviously possible.

DIFFICULT SUPERALLOY RINGS

Some of the nickel and/or cobalt base superalloys as those known by the trademark IN 100, Wasploy, Rene 41, and Udimet 700 are considered to be difficult to fabricate by conventional methods. The particle ring rolling process of the invention is particularly suitable for such difficult alloys. The particles can be alloyed or blended. If blended particles are used, the homogenization would occur during processing. Contoured rings can also be produced by properly designing the annular can.

The invention is also applicable to super-alloy rings subject to critical operating conditions, such as those used in engine structures for high speed aircraft. Such rings require high mechanical strength at operating temperatures materially higher than 1500°F. As superalloy particles ordinarily yield products with a very fine grain size, the mechanical strength thereof at high temperatures is lower than for cast-alloy products, for example, wherein grain growth has increased the high temperature strength. Due to the complex nature of many superalloys, adequate grain size cannot be achieved by conventional heat treatments below the solidus temperature.

When using alloyed particles, the workpiece is heated to a temperature approximating the solidus temperature (for sintering the particle mass), and then ring-rolled to increase the density of the sintered mass. Following the preliminary ring-rolling, the ring is reheated to a point above the solidus temperature, the temperature limit being higher with increased density of the particle mass. Ring-rolling is started at this point and continued until the ring temperature is well below the solidus temperature. The harmful effects of any cast structures in the ring can be eliminated by rolling at a small deformation rate per pass. Heating and ring-rolling as described above through the solidus temperature range is repeated. The ring is provided with a final heat treatment for stabilizing the grain size and shape.

As described above, the process invention lends itself to increasing the grain growth of the superalloy ring for achieving high temperature strength while producing a structurally sound ring.

The results of the particle ring-rolling work on the basic metal, alloy and superalloy test samples above, show that sound metal rings can be made in both simple and shaped cross sections according to the invention, and that the properties of the rings so made, including superalloy rings, should be equal to or better than the corresponding properties of rings made by other processes.

The rings with complex cross-sectional shapes can be produced more easily because (a) the encapsulating containers can be designed to preformed shapes, (b) the porous structure of the particle mass in the can has greater formability than a solid form and (c) higher rolling temperatures can be used due to the more homogeneous microstructure.

The anticipated material loss in producing rings according to the invention is less than 20%, even with complex shaped rings of advanced alloys. By contrast, depending upon the difficulty and complexity of working and rolling, the material loss in the conventional process, as the forged billet is transformed into the unfinished ring, ranges from 20 to 50% (before final machining). The material loss approaches the 50% level in rings made from the more difficult-to-work superalloys (e.g., those known by the trademarks Rene 41, Udimet 700, Wasploy and IN 100 etc.) and in rings of complex cross-section.

Summarizing generally, a number of significant advantages, both technical and economic, accrue from the PRR method of the invention. For example, alloys with large freezing ranges such as aluminum can be made into rings with savings in labor and materials; also, blending of metal particles allows a wider range of compositions and properties than attainable by other ring fabrication methods. One of the more important advantages is the improved homogeneity in metal rings, especially super alloy rings, achieved by particle ring-rolling. This homogeneity is due to each superalloy particle being a highly homogeneous micro-ingot. Segregation of carbides and intermetallic phases of the type commonly found in cast superalloys is on a very fine scale in superalloy particles. Thus, a high degree of homogeneity is present in rings made from superalloy particles; this results in greatly improved hot workability over a wide and higher range of temperatures during ring fabrication, with obvious savings in labor costs.

Another advantage is in the use of the method as a development tool or technique. For example, by eliminating the casting and hot forging problems which must be solved each time a new composition is to be evaluated, the invention tends to simplify and reduce the cost of development of new complex superalloys in ring shape.

In brief, the fabrication by particle ring-rolling of composite, multi-phase (blended particles) rings in simple or contoured cross-sections with different densities and a wide range of structural, corrosion, and high temperature properties, are within the scope of this invention.

As used herein, the term "super alloy" means a nickel and/or cobalt base alloy used for high temperature service where relatively high stresses (tensile, thermal, vibratory, and shock) are encountered and where oxidation resistance is frequently required. These superalloys contain intermetallic formers (Ti, Al, etc.) and solid solution strengthening refractory metals (Cb, Mo, W, Ta, etc.). The major part of the strengthening at high temperatures, however, is due to the precipitation of the so called "gamma prime" phase, generally referred to as $Ni_3(Al, Ti)$. Chromium is present to provide oxidation resistance along with some auxiliary strengthening. Zirconium and boron are added for increased malleability or high temperature creep resistance or both.

Having set forth the invention in what is considered to be the best embodiment thereof, it will be understood that variations may be made in the process described above without departing from the spirit of the invention or exceeding the scope thereof as defined in the following claims.

I claim:

1. A metal-worked product of essentially seamless annular configuration comprising a coherent mass of metallurgically bonded particles which has been hot ring rolled to achieve complete densification between a drive roll and a mandrel wherein the drive roll has a larger diameter than the mandrel, and wherein the outer diameter of said annular configuration at least exceeds the thickness as measured in the direction of its principal axis.

2. A metal-worked product in accordance with claim 1 so characterized that the ultimate tensile strength, the yield strength and the percentage elongation of said product substantially approximate a wrought product of the same chemical composition.

3. A metal-worked product in accordance with claim 1 wherein the degree of densification of said particle mass is at least about 99 per cent of maximum possible density of the contained material.

4. A metal-worked product in accordance with claim 1 in which the ratio of the outer diameter of said annular configuration to its wall thickness at least exceeds 10.

5. A metal-worked product in accordance with claim 1 wherein the wall thickness of said annular configuration varies in the direction of its principal axis in accordance with a preselected uniform cross-sectional pattern imposed thereon in the metal-working process in which said product was formed.

6. A metal-worked product in accordance with claim 1 wherein the composition of said annular configuration varies radially and/or in the direction of its principal axis in accordance with a preselected cross-sectional pattern imposed thereon in the metal-working process in which said product was formed.

7. A metal-worked product as specified in claim 1 wherein the particle mass is composed of a superalloy.

8. A metal-worked product as specified in claim 7 wherein the superalloy consists essentially of material known by the trademark Inconel 718.

9. A metal-worked product in accordance with claim 1 which comprises an enclosing metal sheath metallurgically bonded to said mass.

10. A metal-worked product as specified in claim 9, wherein the sheath and particles, respectively, are essentially of materials selected from the group consisting of aluminum and aluminum alloys.

11. A metal-worked product as specified in claim 9 wherein the sheath and particles, respectively, are essentially of material selected from the group consisting of iron, nickel and nickel alloys.

12. A metal-worked product as specified in claim 9 wherein the sheath is of steel.

13. A metal-worked product as specified in claim 9 wherein the sheath is of material known by the trademark Inconel 718.

14. A metal-worked product as specified in claim 9 wherein the thickness of the sheath at the inner and outer peripheries, respectively, of the annular configuration is substantially uniform.

15. A metal-worked product in accordance with claim 9 comprising a metal ring wherein said particle mass comprises titanium carbide particles, and said sheath comprises a ferrous matrix.

16. A metal-worked product in accordance with claim 9 wherein said sheath has a thermal conductivity not exceeding about 0.06 calories per square centimeter per degree centigrade per second.

17. A metal-worked product in accordance with claim 9 wherein said metal sheath comprises an outer cylinder and an inner cylinder, the coefficient of expansion of said outer cylinder exceeding the coefficient of expansion of said particle mass, and the coefficient of expansion of said particle mass exceeding the coefficient of expansion of said inner cylinder.

* * * * *